US008141719B2

(12) United States Patent
Hopper et al.

(10) Patent No.: US 8,141,719 B2
(45) Date of Patent: Mar. 27, 2012

(54) CAROUSEL FOR DISPLAY AND SALE OF GOODS

(75) Inventors: Weston S. Hopper, Winchester, VA (US); Ronald B. Gaudiano, Manhattan Beach, CA (US); Henri Baldan, Mohlin (CH)

(73) Assignee: Nova Ortho-Med, Inc., Carson, CA (US)

( * ) Notice: Subject to any disclaimer, the term of this patent is extended or adjusted under 35 U.S.C. 154(b) by 0 days.

(21) Appl. No.: 12/714,669

(22) Filed: Mar. 1, 2010

(65) Prior Publication Data

US 2010/0213147 A1 Aug. 26, 2010

Related U.S. Application Data

(63) Continuation of application No. 11/701,759, filed on Feb. 2, 2007, now abandoned.

(51) Int. Cl.
*A47G 25/12* (2006.01)

(52) U.S. Cl. ..... 211/62; 211/95; 211/163

(58) Field of Classification Search ..... 211/62, 211/60.1, 70, 68, 67, 78, 95, 196, 205, 163; 248/121, 125.7, 519, 523, 529; 206/461, 206/463, 470, 471; 224/547, 407, 200; 135/65
See application file for complete search history.

(56) References Cited

U.S. PATENT DOCUMENTS 478,646 A 7/1892 Sencenbaugh et al.
929,897 A 8/1909 Taylor
1,065,381 A 6/1913 Martin
1,525,330 A 2/1925 Smith
3,136,426 A 6/1964 Sakuma
3,195,736 A 7/1965 Bomar, Jr.
3,661,270 A 5/1972 Lucci et al.
3,685,661 A 8/1972 Kimmel
3,826,378 A 7/1974 Novak
3,874,512 A 4/1975 Wegley et al.
3,968,882 A 7/1976 Mello
4,046,251 A 9/1977 Brumi
4,091,828 A 5/1978 Jorgensen
4,094,417 A 6/1978 Cairnes et al.
4,614,272 A 9/1986 Shelton et al.
4,753,446 A 6/1988 Mills
4,872,551 A 10/1989 Theros
4,946,034 A 8/1990 Matsubara
5,018,622 A 5/1991 Hartley
5,179,796 A 1/1993 Gephart, Jr.
(Continued)

OTHER PUBLICATIONS

Declaration of Stephen Nicolopulos, John Gunther, Thomas A. Moeller from patent application 11-941835, Sep. 15, 2010.*

*Primary Examiner* — Darnell Jayne
*Assistant Examiner* — Daniel Rohrhoff
(74) *Attorney, Agent, or Firm* — Lewis Brisbois Bisgaard & Smith LLP; Jon Hokanson; Sanford Astor

(57) ABSTRACT

A carousel for display of elongated merchandise comprising a lower pole, a center pole and an upper pole which fit together, a rotatable cylindrical sleeve mounted on the center pole, the sleeve having two hubs, one hub attached to each end of the sleeve, each hub having a plurality of cone shaped recesses for receiving a product holder, a clam shell product holder having a portion adapted to hold an elongated product, the clam shell holder having a cone shaped member which fits into the cone shaped recesses.

2 Claims, 5 Drawing Sheets

U.S. PATENT DOCUMENTS

| | | | | |
|---|---|---|---|---|
| 5,339,968 | A | 8/1994 | Voelz | |
| 5,485,919 | A | 1/1996 | Samberg et al. | |
| 5,586,664 | A | 12/1996 | Taylor | |
| 5,673,802 | A | 10/1997 | Valentino | |
| 5,676,261 | A | 10/1997 | Baughman et al. | |
| 5,690,239 | A | 11/1997 | Ballard | |
| 5,842,567 | A | 12/1998 | Rowe et al. | |
| 5,849,378 | A | 12/1998 | Gask | |
| 6,026,984 | A | 2/2000 | Perrin | |
| 6,308,838 | B1 | 10/2001 | Endean | |
| 6,626,305 | B2 | 9/2003 | Domenig et al. | |
| 6,971,613 | B2 | 12/2005 | Shendelman | |
| 7,243,815 | B2 | 7/2007 | Coppedge et al. | |
| 2003/0015486 | A1 | 1/2003 | Chen | |
| 2005/0096664 | A1 | 5/2005 | Cohn et al. | |
| 2007/0235608 | A1* | 10/2007 | Blye et al. | 248/229.14 |
| 2008/0061016 | A1* | 3/2008 | Nicolopulos et al. | 211/62 |
| 2008/0185354 | A1* | 8/2008 | Hopper et al. | 211/62 |
| 2010/0213147 | A1* | 8/2010 | Hopper et al. | 211/62 |
| 2011/0253652 | A9* | 10/2011 | Nicolopulos et al. | 211/62 |

* cited by examiner

CAROUSEL FOR DISPLAY AND SALE OF GOODS

This application is a continuation of application Ser. No. 11/701,759, filed Feb. 2, 2007, now abandoned which application is incorporated by reference in its entirety.

FIELD OF THE INVENTION

This invention comprises a carousel for the display and sale of goods and merchandise, particularly elongated goods.

BACKGROUND OF THE INVENTION

Traditionally, goods having an elongated profile, such as canes, umbrellas, shovels, rakes, brooms, mops, and the like, are packaged and shipped to retailers in bulk or case quantities. They are usually displayed standing loosely and haphazardly in a pile or hung on a protruding spike, one behind each other, so that only the outermost one is visible. That would suffice if each item hung on the spike was the same, but in order to display a variety of selected merchandise, means have been needed to display many different designs of a product, so that a customer may view all of the different designs and pick the one they want.

SUMMARY OF THE INVENTION

The display carousel of this invention comprises a pole or a plurality of vertical poles, fitting together, either set into a base or attached to a wall. The vertical pole or poles have one or more hubs having a plurality of recesses adapted to receive a product holder. In this manner a large number of products, such as a variety of canes of different designs, can be removably attached to the carousel display. Each of the individual products fits into its own product holder, so that a customer can take it out of the carousel to inspect it and put it back in, once he or she has looked at it. The hub rotates 360 degrees, so that a customer can view all of the products on the carousel while standing in one place and rotating the carousel.

Preferably the hub recesses are cone shaped and the product holder is a clam shell structure having a circular portion to hold the product and a cone shaped member to fit into the cone shaped recesses of the hub.

DETAILED DESCRIPTION OF THE INVENTION

Figure 1:
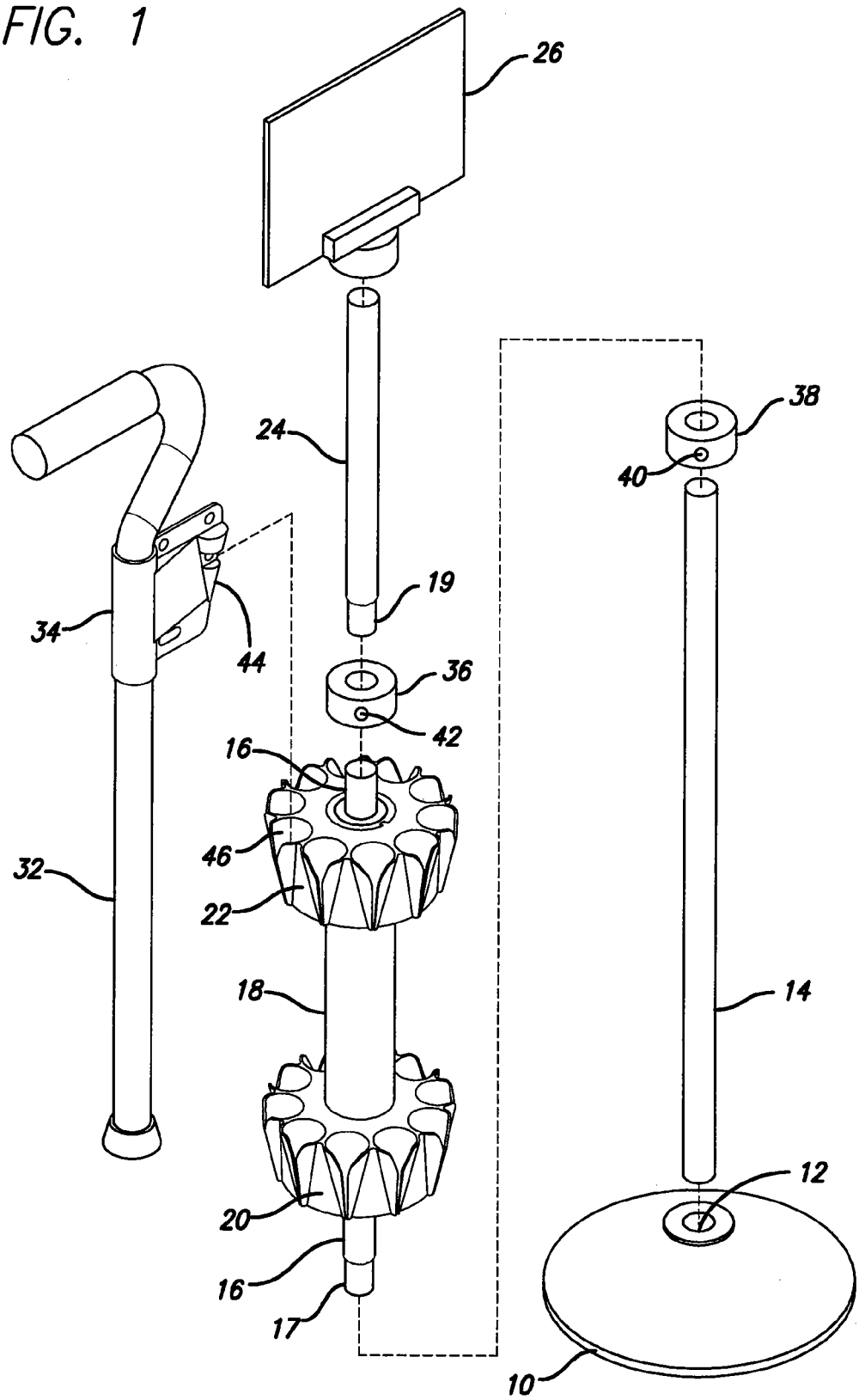
FIG. 1 is an exploded perspective view of the carousel of the invention.
Figure 2:
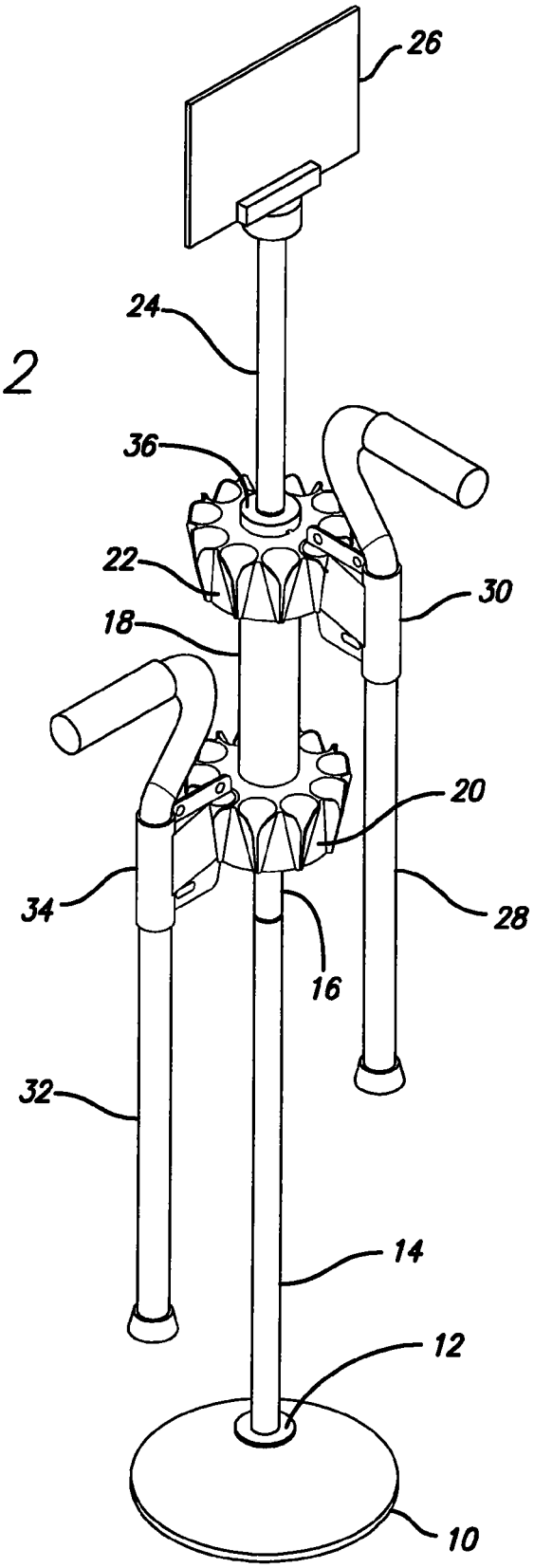
FIG. 2 is a perspective view of the assembled carousel.

Referring now to FIGS. 1 and 2, there is shown a base 10 having a hole 12 to receive a lower pole 14. Pole 14 may consist of one pole or two or more poles, which fit or telescope together. Center pole 16, which has a smaller diameter, narrowed portion 17, fits into the top of pole 14.

A cylindrical sleeve 18 has two hubs 20 and 22 attached, one at each end of sleeve 18. Sleeve 18 fits onto pole 16 and is held from sliding down pole 16 by locking ring 38. Locking ring 38 is attached to pole 16 by set-screw 40.

Upper pole 24, which may be a single pole or a plurality of telescoped poles, has a narrowed portion 19, which fits into the top of pole 16. Locking ring 36, having set-screw 42, locks onto the top of pole 16 to hold sleeve 18 tightly in place.

The number of poles used, and their length, makes the carousel available in any height desired. Also, adjustable poles may be utilized, so that the height of the carousel can be adjusted, even after purchase and set up.

An optional sign 26 indicating the contents of the carousel, price and/or any other information desired, is attached to the top of pole 24.

Base 10 is heavy enough to securely hold the carousel so that it is stable, even when fully loaded with product.

Hubs 20 and 22 fit onto sleeve 18 and are fixedly attached to sleeve 18, as later described, so that when sleeve 18 is rotated, hubs 20 and 22 also rotate, 360 degrees. In this manner a customer can stand in one place and view all of the products hung on the carousel, by rotating the product hanging on the carousel.

Sleeve 18 and hubs 20 and 22 all rotate together as a unit. Hubs 20 and 22 cannot rotate separately, as rotation of one hub would be blocked by the products hanging from the other hub.

Figure 5:
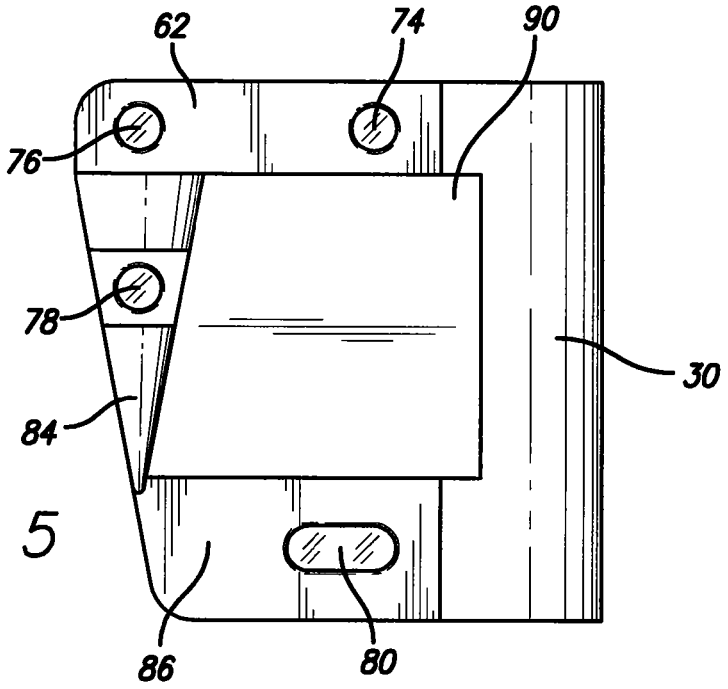
FIG. 5 is a side view of a product holder.
Figure 6:
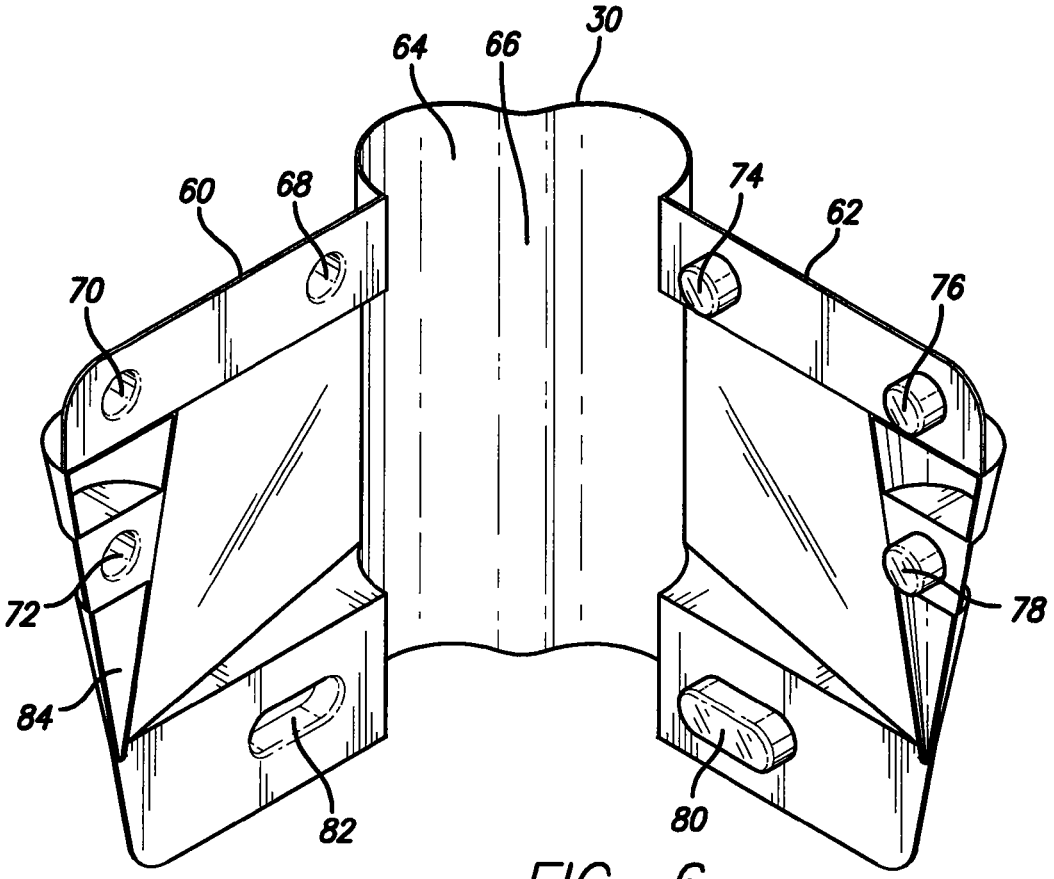
FIG. 6 is a perspective view of a product holder in the open position.
Figure 7:
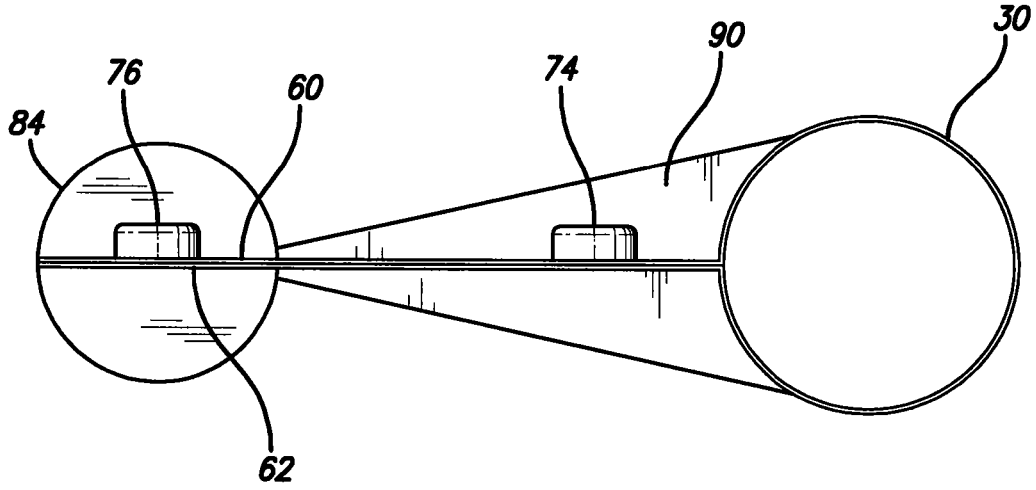
FIG. 7 is a top view of a product holder in the closed position.

A cane 32 is held by clam shell product holder 34, described in detail in FIGS. 5, 6 and 7. Clam shell holder 34 has a cone shaped member 44, which snugly fits into one of a plurality of cone shaped recesses 46 in hub 22. In FIG. 2, which shows the assembled carousel, cane 32 is placed in one of a plurality of cone shaped recesses in hub 20. The cone shaped recesses 46 of hub 22 are offset from the cone shaped recesses 46 of hub 20, so that elongated products, such as the canes shown, will be individually separated and able to hang freely from each cone shaped recess, without interfering with each other. This also has the benefit of less damage occurring to the products from the products hitting against each other.

Figure 3:
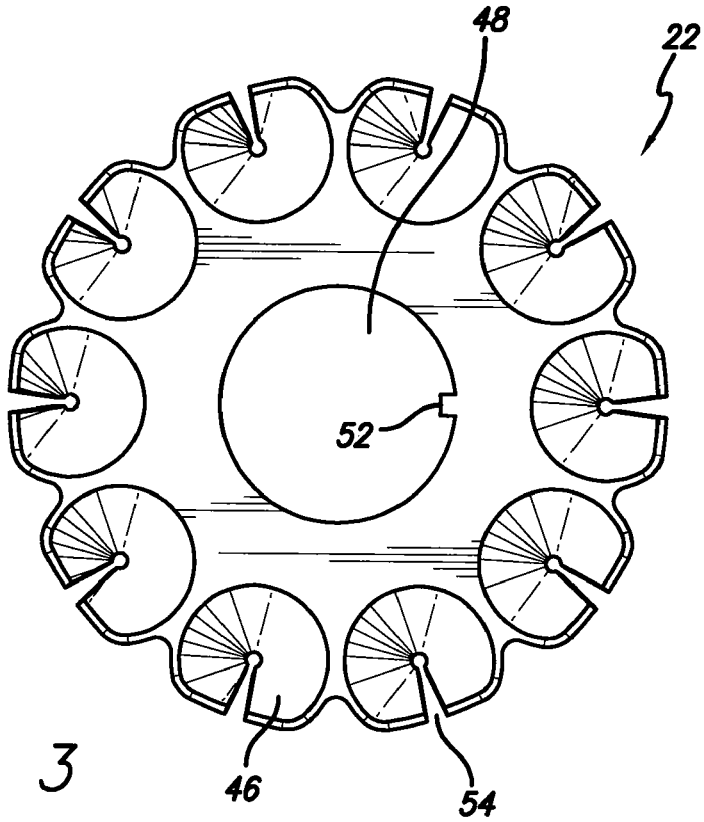
FIG. 3 is a top view of a hub of the carousel.
Figure 4:
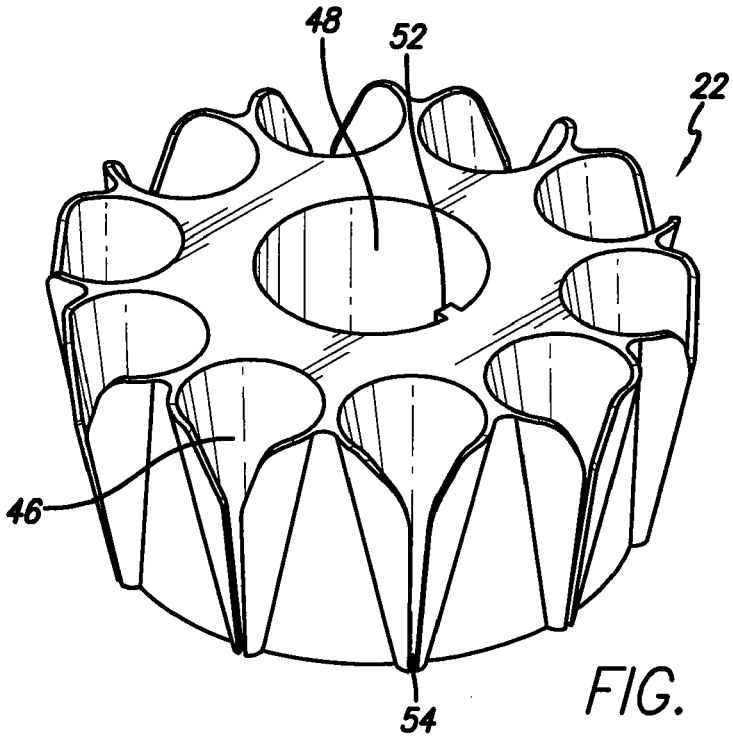
FIG. 4 is a perspective view of a hub.

Referring to FIGS. 3 and 4, each cone shaped recess 46, of hub 22, has an open slot 54 so that a clam shell product holder, 105 such as 30 or 34, can fit into a cone shaped recess 46 and extend outward to hold an elongated product, such as cane 32.

Hub 22, has a central bore 48, which fits over sleeve 18. Central bore 48 has a key 52, which fits into and engages a slot in sleeve 18. Key 52 locks hub 22 onto sleeve 18. Hub 20 has a 110 similar key, which also fits into a slot in sleeve 18, so that sleeve 18, hub 20 and hub 22 all rotate together, as one unit.

While as shown, key 52 is part of hub 20, 22, to engage a slot in sleeve 18, this structure may be reversed, so that a key or narrow raised strip may be located on sleeve 18 to engage a 115 slot in central bore 48 of hubs 20, 22. Other means may also be used to lock hubs 20, 22 to sleeve 18, so that they all rotate together.

Locking rings 36 and 38 both lock onto center pole 16 just above and just below sleeve 18. In this manner, sleeve 18, hub 120 20 and hub 22 rotate as a unit around pole 16.

As shown, both hub 20 and hub 22 have ten cone shaped recesses, offset as stated above, so that the carousel will hold twenty items at one time. The total number of cone shaped recesses in each hub may vary depending upon the size and shape 125 of the product and the desire of the manufacturer. Depending upon the length of the products and the desire of the manufacturer, the carousel may have one or more hubs for hanging product.

Referring to FIGS. 5, 6 and 7, there is shown a detailed 130 view of the clam shell product holder, such as 30, 34 of this invention. Clam shell 30, 34 is a thermoformed plastic material which has three sections. There are two opposing side sections 60 and 62 and a center section 64. Center section 64 is shaped so that when side sections 60 and 62 are pressed together, a 135 circular area 66 is created in center section 64.

Side section 60 has a plurality of female slots 68, 70, 72 and 82 adapted to receive male buttons 74, 76, 78 and 80, which are on side section 62. Male buttons fit tightly into female slots 68, 70, 72 and 80, respectively, and clam shell product 140 holder 30, 34 then has a profile in which a circular area 66, in which a cane can be held, is formed at one end and a cone shaped member 84 is formed at the other end, with a narrow middle section 86. Narrow middle section 86 fits through slot 54 in hub recess 46. Cone shaped member 84 is sized to substantially 145 fill cone shaped recess 46, so that clam shell holder 30, 34 fits securely into cone shaped recess 46 and is held with great stability, even when an elongated product, such as a cane, is being held in circular portion 66.

Center area 90 can be used to hold an information package, 150 or any other written or graphic material desired.

Clam shell holder 30, 34 is made of any suitable plastic, such as a thermoformed plastic used for packaging of various products.

An alternative to the button closing system described, is 155 to weld or seal the two side sections 60, 62 together. Sealing the two side sections together, after the product has been inserted into the circular portion 66, provides more security, in that the clam shell holder cannot be easily removed in the store. Also, security features, such as a door alarm activator 160 could be inserted into the clam shell holder to prevent theft.

The advantages of the instant invention are many. They include the fact that products that are bulky and hard to merchandise are organized into an easy-to-shop environment. The carousel takes product out of the box and displays it in a 165 manner that the consumer can touch. In addition, many different designs of the product are easily visible on a rotating hub, so that they are all easy to see, easy to remove from the hub and easy to replace, giving the consumer an easy way to make a choice. The carousel also maximizes expensive retail space, 170 placing a large number of items in a small compact space and puts it at eye level to a wider array of consumers.

In addition, the instant invention provides a way to market elongated products, such as canes, umbrellas, shovels, rakes, brooms, mops, baseball bats, and the like, which is more 175 profitable for the retailer. It allows the retailer to purchase one display carousel that will fit into any retail application, in that the carousel can be made free standing, as shown, or it may be attached to a wall by use of a wall bracket. When mounted on a wall, usually a smaller base will be used. In 180 addition, the carousel of this invention reduces the overhead of distributors by allowing them to inventory only one display and makes reorder of particular designs easier.

We claim:

1. A cane carousel display for display a plurality of canes comprising:

a first vertical pole;

a base adapted to rest on a horizontal surface and retaining said first pole in a stationary position relative to said base;

a second stationary vertical pole;

a hub having a plurality of openings, said hub rotatably attached to said first pole and rotatably attached to said second pole;

a plurality of clam shell cane holders removably retained on said hub;

each of said clam shell cane holders including a circular section, a cone shaped member and a center area;

each said circular section adapted to retain a cane; and, each said cone shaped member adapted to be removably retained by said hub.

2. A cane carousel display for display of a plurality of canes comprising:

a first vertical pole;

a base adapted to rest on a horizontal surface and retaining said first pole in a stationary position relative to said base;

a second stationary vertical pole;

a first hub having a plurality of openings, said first hub rotatably attached to said first pole and rotatable with respect to said second pole;

a plurality of clam shell cane holders removably retained on said first hub;

a sleeve extending from said first hub to a second hub;

said second hub having a plurality of openings offset from the plurality of openings on said first hub, said second hub rotatable with respect to said first pole and rotatably attached to said second pole;

a plurality of clam shell cane holders removably retained on said first hub and removably retained on said second hub;

each of said clam shell cane holders including a circular section, a cone shaped member and a center area;

each said circular section adapted to retain a cane;

each said cone shaped member adapted to be removably retained by said first hub or by said second hub.

* * * * *